US008689972B2

(12) United States Patent
Sanchez et al.

(10) Patent No.: US 8,689,972 B2
(45) Date of Patent: Apr. 8, 2014

(54) PACKAGING FOR A LIQUID, POWDERY OR PASTY PRODUCT

(75) Inventors: Jesus Sanchez, Haldenwang (DE); Paul Roland, Aalsmeer (NL)

(73) Assignee: Multivac Sepp Haggenmueller GmbH & Co. KG, Wolfertschwenden (DE)

( * ) Notice: Subject to any disclaimer, the term of this patent is extended or adjusted under 35 U.S.C. 154(b) by 227 days.

(21) Appl. No.: 13/187,861

(22) Filed: Jul. 21, 2011

(65) Prior Publication Data

US 2012/0018335 A1 Jan. 26, 2012

(30) Foreign Application Priority Data

Jul. 21, 2010 (DE) ..... 10 2010 031 734

(51) Int. Cl.
*B65D 25/08* (2006.01)
*B65D 35/22* (2006.01)

(52) U.S. Cl.
USPC ..... 206/219; 206/469; 222/94; 222/107; 222/541.6

(58) Field of Classification Search
USPC ..... 206/205, 209, 210, 219, 221, 223, 229, 206/469, 568; 220/23.8; 222/94, 106, 107, 222/541.6, 96, 541.3, 541.4; 426/120
See application file for complete search history.

(56) References Cited

U.S. PATENT DOCUMENTS

| | | | | |
|---|---|---|---|---|
| 2,705,579 | A * | 4/1955 | Mason | 222/107 |
| 3,315,801 | A * | 4/1967 | Lowry | 206/469 |
| 3,510,054 | A * | 5/1970 | Carlo et al. | 426/122 |
| 4,611,715 | A * | 9/1986 | Redmond | 222/107 |
| 4,724,982 | A * | 2/1988 | Redmond | 222/94 |
| 4,790,429 | A * | 12/1988 | Fukushima | 206/219 |
| 5,209,347 | A * | 5/1993 | Fabisiewicz et al. | 206/219 |
| 5,215,221 | A * | 6/1993 | Dirksing | 222/94 |
| 7,776,290 | B2 | 8/2010 | Michalsky et al. | |
| 7,934,864 | B2 | 5/2011 | Heusser et al. | |
| 2003/0222099 | A1 * | 12/2003 | Keller | 222/94 |
| 2008/0230571 | A1 * | 9/2008 | Sterngold et al. | 222/541.4 |

FOREIGN PATENT DOCUMENTS

| | | | |
|---|---|---|---|
| DE | 39 00 702 | C1 | 4/1990 |
| DE | 10 2005 000 832 | A1 | 12/2005 |
| DE | 10 2006 018 038 | A1 | 10/2007 |
| EP | 0 280 784 | A1 | 9/1988 |
| EP | 1 133 969 | A1 | 9/2001 |
| WO | 2006/079413 | A2 | 8/2006 |
| WO | 2007/068862 | A2 | 6/2007 |

OTHER PUBLICATIONS

German Search Report Dated Apr. 2, 2011, Application No. 10 2010 031 734.9-27, Applicant Multivac Sepp Haggenmueller GmbH & Co. KG, 3 Pages.

* cited by examiner

*Primary Examiner* — Luan K Bui
(74) *Attorney, Agent, or Firm* — Husch Blackwell LLP

(57) ABSTRACT

The disclosure relates to a packaging for a liquid, powdery or pasty product, comprising a first packaging part and a second packaging part which are connected to each other along a connecting area to define between them a hollow space to receive the product, wherein a channel is provided between the first packaging part and the second packaging part, which is to be opened by opening a sealing element to dispense the product from the packaging. The disclosure is characterized in that the sealing element is a sealed seam between the first packaging part and the second packaging part, which seals the channel, and that the sealed seam comprises inside the channel at least one portion which projects in a longitudinal direction of the channel. The disclosure also relates to a packaging machine for manufacturing such a packaging.

19 Claims, 9 Drawing Sheets

PACKAGING FOR A LIQUID, POWDERY OR PASTY PRODUCT

CROSS-REFERENCE TO RELATED APPLICATIONS

This application claims foreign priority benefits under 35 U.S.C. §119(a)-(d) to German patent application number DE 102010031734.9, filed Jul. 21, 2010 which is incorporated by reference in its entirety.

TECHNICAL FIELD

The disclosure relates to a packaging according for a liquid, powdery or pasty product.

BACKGROUND

A packaging of this type is known, for instance, from EP 0 280 784 B1. This conventional packaging comprises two packaging portions, each with its own packaging hollow space, which are connected to each other along a bending line. In the area of the bending line, for instance, a deep-drawn container as a first packaging part and a lid film as a second packaging part are not completely sealed with each other. Thus, an independent dispensing channel is created for each packaging portion if the two halves of the packaging are tilted towards each other around the bending line. This conventional packaging has the disadvantage that it is weakened by the bending line, especially in the area of the dispensing channels, so that an undesired, too early discharge of the product from the packaging is possible. Another disadvantage is the necessity that the dispensing channels have to be offset relative to each other so as to prevent the flow of the product from one packaging half into the other packaging half. However, this offset prevents at the same time the products in the two packaging halves from being mixed with each other immediately when they flow out of the packaging, which may be desirable for certain products. In addition, the packaging may open up inadvertently when accidentally bent at the bending line.

A multi-chamber container in the form of a hose-in-hose system is known from DE 10 2006 018 038 B4. The two chambers of the tubular container are sealed by a diaphragm until the time of use.

Another two-chamber container is disclosed in U.S. Pat. No. 4,611,715. Similar to EP 0 280 784 B1 two chambers are provided, which are connected to each other along a bending line. If the two chambers are tilted around the bending line a projection in the lower part of the container pierces the lid film. By this, the lid film can be opened without having to apply an excess pressure of the product to the opening area in order to open it. According to U.S. Pat. No. 4,611,715 this has the advantage that a splashing of the product is prevented when the container is opened.

Multi-chamber containers are also known from EP 1 133 969 A1 or WO 2007/068862 A2. Each chamber of the container is sealed by a sealing portion which can be detached by means of a tool or a predetermined breaking point so as to open a dispensing channel for the product. The disadvantage thereof is that the detached sealing portion has to be disposed of as waste in addition to the rest of the packaging.

Finally, WO 2006/079 413 A2 discloses another multi-component foil-type container comprising a comparatively complicated separate mixing device for the products contained in both chambers in an oblong joint dispensing channel.

SUMMARY

It is the object of the present disclosure to provide a packaging for a liquid, powdery or pasty product which is easy to manufacture and open while, at the same time, an undesired opening thereof is prevented in a best possible manner.

The packaging according to the disclosure is particularly suited to receive and dispense in a precisely dosed manner a liquid, powdery or pasty product. The product may be a beverage, beverage ingredients, cosmetics, powdery or pasty foodstuffs such as spices, sauces, ketchup or mayonnaise, paints or paint pigments, adhesives or components of adhesives or other chemicals.

In the packaging according to the disclosure the sealing element is a sealed seam between the first packaging part and the second packaging part which seals the dispensing channel for the product, and the sealed seam comprises inside the channel at least one portion which projects in a longitudinal direction of the channel. The first packaging part and the second packaging part may be a packaging tray deep-drawn from a plastic sheet and a lid film sealing this packaging tray. These two packaging parts may be sealed, welded, glued or connected differently to each other along the connecting area so as to reliably prevent the product from escaping through the connecting area. The dispensing channel has a longitudinal direction into which the product is dispensed from the packaging. In this longitudinal direction, i.e. in the dispensing direction or opposite to the dispensing direction, the sealed seam has a projecting portion inside the channel. If a higher pressure is built up in the hollow space of the packaging, e.g. by pressing the packaging together, this pressure also acts on the sealed seam, where it attempts to separate the two packaging parts (i.e., for instance, the two packaging films) in the area of sealed seam. The forces acting in the direction of a separation of the two packaging parts concentrate at the projecting portion of the sealed seam. Thus, the projecting portion constitutes some kind of predetermined breaking point of the sealed seam, where the sealed seam opens up earlier as compared to other areas. This opening in the sealed seam then continues on both sides of the projecting portion. Therefore, owing to the presence of the projecting portion of the sealed seam, a defined, controlled opening of the sealed seam and, thus, a well-directed dispensing of the product out of the packaging can be achieved.

It is favorable if the sealed seam is narrower in the area of the at least one projecting portion than offside of this projecting portion. Moreover, owing to the lower holding forces between the two packaging parts in the narrower area of the sealed seam it is further facilitated that the sealed seam opens up at its projection portion first. It can be controlled by means of the width of the sealed seam in the area of the projecting portion and by means of the shape of the projecting portion at which internal pressure of the packaging the sealed seam opens up.

Preferably, the at least one projecting portion is disposed on the side of the sealed seam facing the hollow space that receives the product. At first sight, this might appear to be a disadvantage because the product being subjected to an increased internal pressure penetrates into the areas next to the projecting portion, so that a separation of the sealed seam next to the projecting portion could be feared. However, it has shown that the arrangement of the projecting portion on this inner side of the sealed seam on the contrary improves the opening behavior as the projecting portion is directly exposed to the internal pressure of the packaging and the opening up of the sealed seam can be continued from the projecting portion to the edge regions, so that the sealed seam indeed opens up at the projecting portion first.

It is useful if the at least one projecting portion of the sealed seam is disposed centrally in the channel in the transverse direction, i.e. centrally between the two lateral edges of the channel. This has the advantage that the opening process starts in the center of the channel. Opening the channel symmetrically starting from its center improves the well-directed dispensing of the product from the packaging.

According to an advantageous modification of the disclosure the first packaging part and the second packaging part lie on top of each other surface to surface in the area of the channel before the sealing element, i.e. the sealed seam is opened up. This has a positive effect on the sealing of the two packaging parts along the sealed seam.

The sealed seam need not have only one projecting portion, but it can also have several projecting portions, preferably on its side facing the hollow space that receives the product. Especially if the dispensing channels are broader, which accelerate the product dispensing, it can be achieved that the channel is opened up at several places simultaneously so as to open the channel more rapidly.

The sealed seam can be, for instance, V-, U-, W-, C-, E- or M-shaped. Together with the width of the sealed seam and the sealing parameters (pressure and temperature) the shape determines the forces that are necessary for opening the sealed seam. The more acute the shape of the projecting portion of the sealed seam is, the stronger is the concentration of the opening forces on the projecting portion, and the earlier will the sealed seam be opened up. This means that a V-shape requires lower opening forces than, for instance, a U- or C-shape of the sealed seam.

The packaging according to the disclosure permits to provide not only a first packaging portion having a first hollow space, but also a second packaging portion having a second hollow space or even further packaging portions having further hollow spaces. This has the advantage that several products can be received separately from each other. This is particularly suited for products that are usable optionally (e.g. different flavor additives for foodstuffs) or that are supposed to react with each other after they have been dispensed, such as the components of a two-component adhesive.

Preferably, the two packaging portions are then connected to each other along a bending line. This bending line may serve as a predetermined breaking point for separating the two packaging portions from each other. Moreover, the two hollow spaces of the two packaging portions can be pressed against each other when the packaging portions are tilted around the bending line so as to increase the internal pressure in the two hollow spaces and open up the packaging portions.

It is useful if the sealed seams in the two channels are offset relative to the bending line towards the hollow space of the respective packaging portion. In this way it can be ensured (e.g. in contrast to EP 0 280 784 B1) that the two dispensing channels are not already opened by only bending the packaging portions along the bending line, but only later by increasing the internal pressure in the two packaging portions.

According to a modification of the inventive packaging comprising several packaging portions a cut-out is provided on the bending line. This cut-out has a double function. On the one hand, it represents a weakening of the packaging on the bending line, so as to define the bending line and reduce the forces required for the bending. On the other hand, it can control the dispensing behavior of the product from the packaging.

In order to be able to achieve a particularly good accomplishment of the latter function the cut-out is preferably arranged between the two channels of the two packaging portions.

Preferably, the cut-out is circular or diamond-shaped. This has the advantage that the cut-out concentrates the product flow as it is dispensed. At the same time, a circular or diamond-shaped cut-out permits a particularly good definition of the bending line or desired separation line.

According to a useful modification of the disclosure the separation force, which is necessary for separating the first packaging part from the second packaging part, is higher in the connecting area between the two packaging parts than at the sealed seam. This ensures that the product is dispensed at any rate through the defined dispensing channel and not sideways through the connecting area.

In order to increase the separation forces a double sealing or a sealing broader than that of the sealed seam may be provided at least section-wise in the connecting area. This double sealing may be realized in such a way that a weak sealing is realized first, and a firmer, stronger sealing subsequently. These two sealings can be accomplished either on exactly the same portion of the packaging, or the second, firmer sealing can be accomplished next to the first sealing so that two, e.g. parallel sealing portions are formed which are arranged next to each other.

According to a favorable modified embodiment the packaging comprises a funnel-shaped portion between the hollow space and the dispensing channel for the product. This funnel-shaped portion can help to bundle the product flowing out of the hollow space towards the dispensing channel so as to facilitate the dispensing of the product and make sure that the packaging is completely emptied.

The disclosure finally also relates to a packaging machine for manufacturing a packaging of the above-described type.

Advantageous embodiments of the disclosure will be explained below in more detail with reference to the below drawings.

DETAILED DESCRIPTION

Like components will be designated with like reference numbers throughout the figures.

Figure 1:
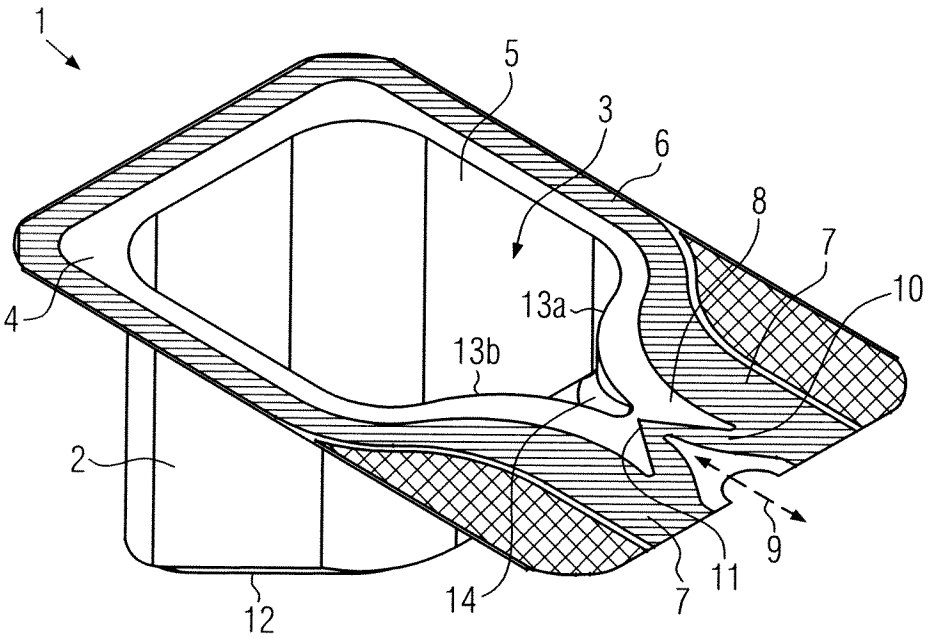
FIG. 1 shows a perspective view of a first embodiment of a packaging according to the disclosure.

FIG. 1 shows a perspective view of a first embodiment of an inventive packaging 1 for a liquid, powdery or pasty product. The packaging 1 comprises a first packaging part 2 which, in this case, is a packaging tray deep-drawn from a plastic sheet. The first packaging part 2 comprises a hollow space 3 to receive the liquid, powdery or pasty product (the product itself is not illustrated in this figure and the other figures). A horizontal lateral edge 4 joins the hollow space 3 outwardly.

The packaging 1 further comprises a second packaging part 5, which is a transparent lid film sealing the first packaging part 2. This second packaging part 5 lies on the first packaging part 2, on the plane defined by the edge 4.

In a connecting area 6 the two packaging parts 2, 5 are connected firmly to each other and are separable, at the most, by applying very high separation forces. This connecting area 6, which is approximately bottle-shaped in the embodiment according to FIG. 1, is provided between the first packaging part 2 and the second packaging part 5, on the plane defined by the edge 4. In the connecting area 6 the two packaging parts 2, 5 may be connected to each other by a sealing, by a welded connection or by a glued connection.

Except for the area 7 of the "bottleneck" of the bottle-shaped connecting area 6 the connecting area 6 has a constant width around the hollow space 3. In the area 7 of the "bottleneck" the connecting area 6 is broader than in the other areas, however. This has the advantage that the two packaging parts 2, 5 are attached to each other particularly strongly in the area of the bottleneck of the connecting area 6.

A channel 8 for dispensing the product from the packaging 1 is defined between the two broader areas 7 of the "bottleneck" of the connecting area 6. This dispensing channel 8 has a longitudinal direction 9 which runs parallel to the two lateral, broader areas 7 of the connecting area 6 and defines the dispensing direction of the product from the packaging 1.

In the initial state shown in FIG. 1 the dispensing channel 8 is sealed by a sealing element 10 which, according to the disclosure, is a sealed seam 10. This sealed seam 10 connects the two packaging parts 2, 5 to each other in the area of the dispensing channel 8 and seals the dispensing channel 8. Only when the sealed seam 10 is opened, is the channel open 8 for dispensing the product from the packaging 1.

In the embodiment shown the sealed seam 10 is V-shaped, and it has a projecting portion 11 on its side facing the hollow space 3. This projecting portion 11 projects from the sealed seam 10 in the longitudinal direction 9 of the channel 8, namely opposite to the dispensing direction of the product from the packaging 1.

The hollow space 3 of the first packaging part 2 comprises a bottom 12 which rises towards the dispensing channel 8. Moreover, the side walls 13*a*, 13*b* of the first packaging part 2 converge towards the channel 8. Thus, the rising bottom 12 and the side walls 13*a*, 13*b* of the first packaging part 2 define a funnel 14 which directs the product to be dispensed towards the dispensing channel 8.

Figure 2:
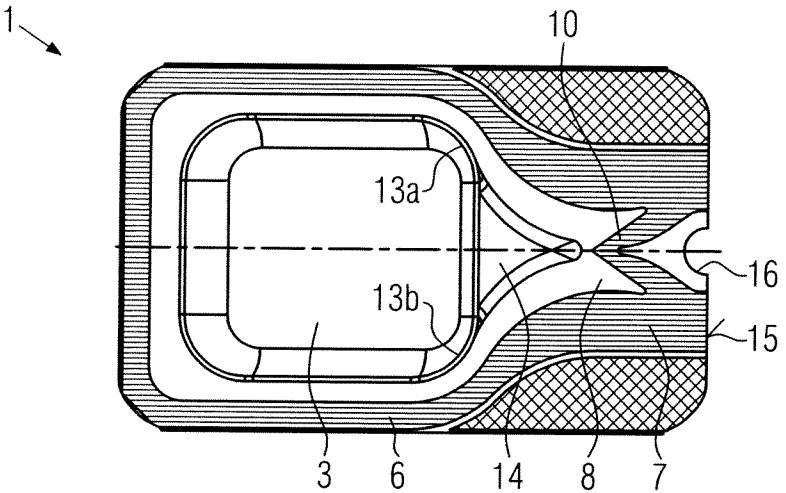
FIG. 2 shows a top view of the packaging illustrated in FIG. 1.

FIG. 2 shows a top view of the packaging 1 illustrated in FIG. 1. This packaging 1 can have, for instance, a length of approximately 9 cm and a width of 5 to 6 cm. Other dimensions are conceivable as well.

FIG. 2 shows particularly well how the side walls 13*a*, 13*b* of the first packaging part 2, which converge towards each other, define a funnel 14 between them for channeling the product towards the dispensing channel 8.

A semi-circular cut-out 16 is provided at the outer edge 15 of packaging 1 along a direct extension of the center axis of the channel 8. This cut-out 16 is provided both in the first packaging part 2 and the second packaging part 5. This cut-out 16 concentrates the product flowing out through the channel 8 on the center axis of the channel 8, thereby improving the dispensing behavior of the product. All corners of the hollow space 3 are formed with a radius of at least 10 mm, and so are the junctions from the hollow space 3 into the channel 8. In this way it is prevented that residues of the product accumulate in the corners of the hollow space 3, which do not participate in the dispensing of the product from the packaging 1.

Figure 3:
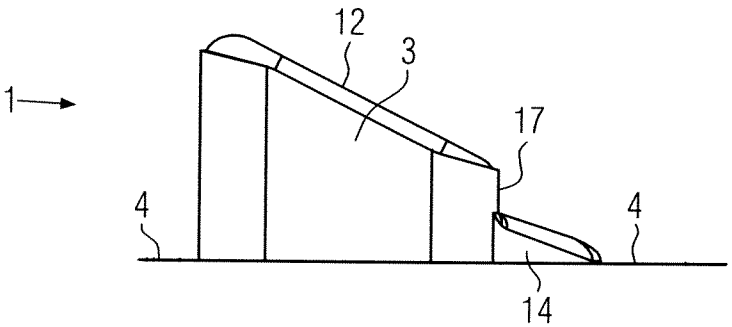
FIG. 3 shows a lateral view of the packaging illustrated in FIG. 1.

FIG. 3 is a lateral view of the packaging 1 illustrated in FIGS. 1 and 2. It can clearly be seen that the bottom 12 of the hollow space 3 is inclined relative to the plane of the edge 4 and rises towards the channel 8. The deepest point of the bottom 12 is deep-drawn down to a depth of approximately 43 mm with respect to the plane of the edge 4.

Towards the channel 8 there is provided a step 17 between the hollow space 3 and the funnel-shaped portion 14. In the area of the channel 8 the first packaging part 2 is no longer deep-drawn. Consequently, the two packaging parts 2, 5 lie on top of each other surface to surface in the area of channel 8.

Figure 4:
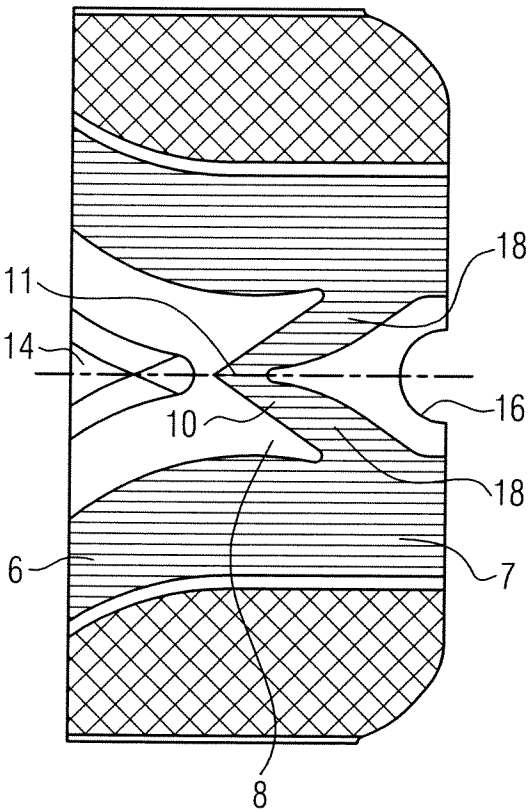
FIG. 4 shows an enlarged top view of the sealed seam of the packaging illustrated in FIG. 1.

FIG. 4 shows the dispensing channel 8 of the first embodiment in an enlargement. It can clearly be seen that the projecting portion 11 defines a point on the side of the sealed seam 10 facing the hollow space 3, whereas the outwardly directed side of the sealed seam 10 directly opposite the projecting portion 11 is round. Also, it can clearly be seen that the sealed seam 10, which serves as a sealing element, is narrower at the projecting portion 11 than in its edge regions 18 offside of the projecting portion 11. As a consequence, the forces to be applied for opening the sealed seam 10 are lowest in the central region, i.e. at the projecting portion 11. If the internal pressure in the hollow space 3 is increased, e.g. by manually pressing the hollow space 3 together, the holding forces at the projecting portion 11 are overcome first as a result of the higher internal pressure, so that this is where the second packaging part 5 (i.e. the lid film) is separated from the first packaging part 2. Additionally, this process is supported by the concentration of the higher internal pressure on the point of the projecting portion 11. The separation of the second packaging part 5 starting at the projecting portion 11 continues into the edge regions 18 of the sealed seam 10 nearly in parallel to the direction of the product flowing out of the packaging 1, in order to thereby fully open up the channel 8.

Figure 5:
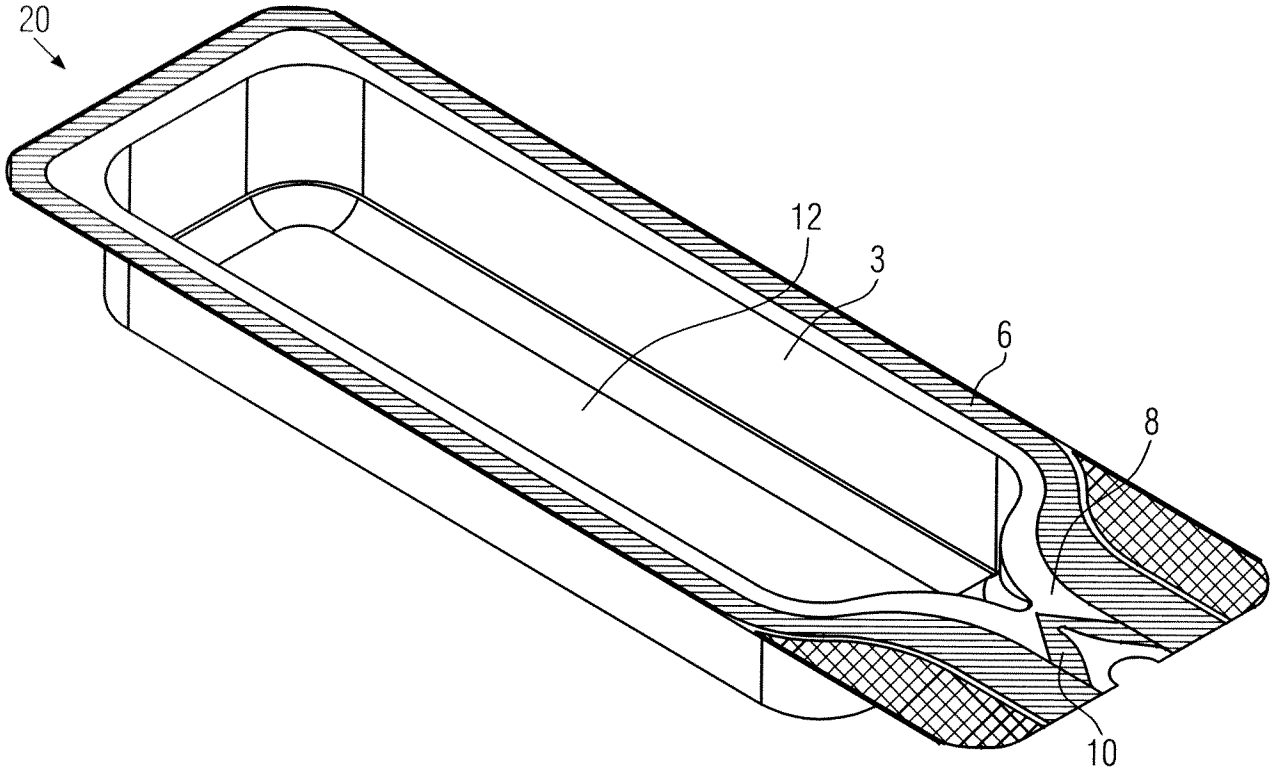
FIG. 5 shows a perspective view of a second embodiment of a packaging according to the disclosure.

FIG. 5 shows a second embodiment of a packaging 20 according to the disclosure. It differs from the first embodiment particularly in that the packaging 20 is longer and has, for instance, a total length of 15 to 20 cm. Another difference is that the bottom 12 of the hollow space 3 of packaging 20 is plane.

Another difference is the formation of the sealed seam 10 of the dispensing channel 8 which serves as a sealing element. In the first embodiment the hatching shows that the connecting area 6 and the sealed seam 10 are formed alike. The separation forces in the connecting area 6, which have to be overcome for separating the lid film 5 from the first packaging part 2, are higher than those of the sealed seam 10 because the sealed area in the connecting area 6 is broader than that of the sealed seam 10, at least at the projecting portion 11 of the sealed seam 10. In the second embodiment, however, although the sealed seam 10 has the same shape as in the first embodiment, the sealed seam 10 is formed differently from the rest of the connecting area 6. This can be achieved, for instance, by using sealing parameters for the production of the sealed seam 10 that differ from those used for the production of the connecting area 6, or by producing the connecting area 6 not by sealing, but by gluing. However, in the second embodiment, too, the forces required for separating the lid film 5 are lower at the sealed seam 10 than in the connecting area 6, thereby ensuring that the product flows out of the packaging 20 only through channel 8.

Figure 6:
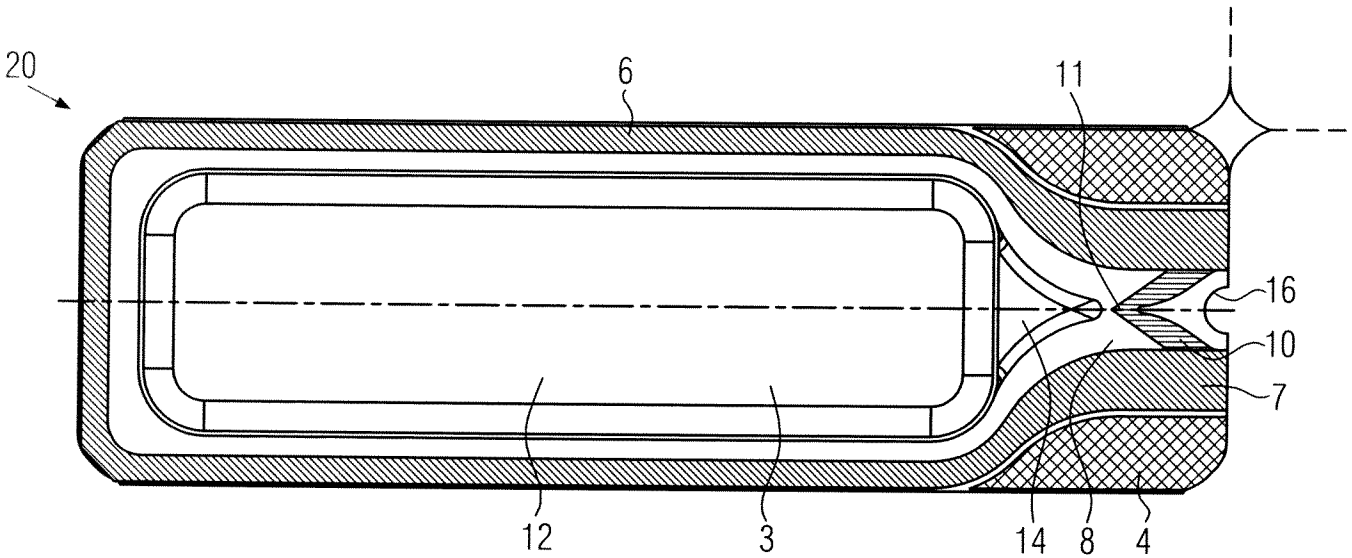
FIG. 6 shows a top view of the packaging illustrated in FIG. 5.

FIG. 6 shows a top view of the packaging 20 illustrated in FIG. 5. The comparison of FIG. 6 with FIG. 2 clearly shows that the sealed seam 10 of both packagings 1, 20 has the same shape. The cut-out 16 on the right side, too, is provided in both embodiments. The diamond-shaped area in the upper corner on the right side of FIG. 6 implies that the rounded corners of four adjacent packagings 20 may encounter each other at this point.

Figure 7:
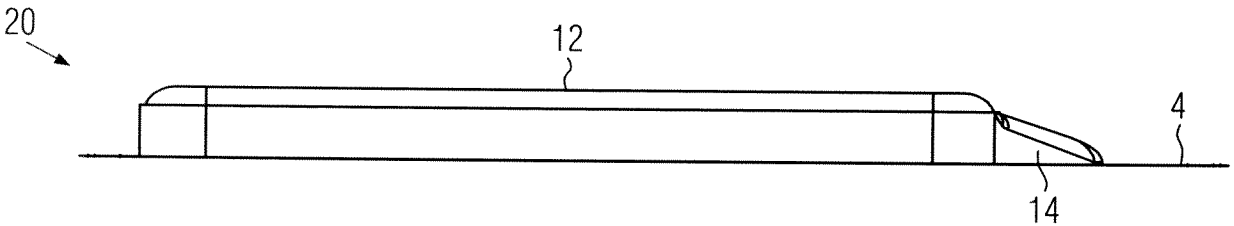
FIG. 7 shows a lateral view of the packaging illustrated in FIG. 5.

FIG. 7 shows a lateral view of the second embodiment of a packaging 20 according to the disclosure. In contrast to the first embodiment the bottom 12 of packaging 20 is plane, and there is no step between the bottom 12 and the funnel-shaped portion 14 by means of which the hollow space 3 passes over into the dispensing channel 8.

Figure 8:
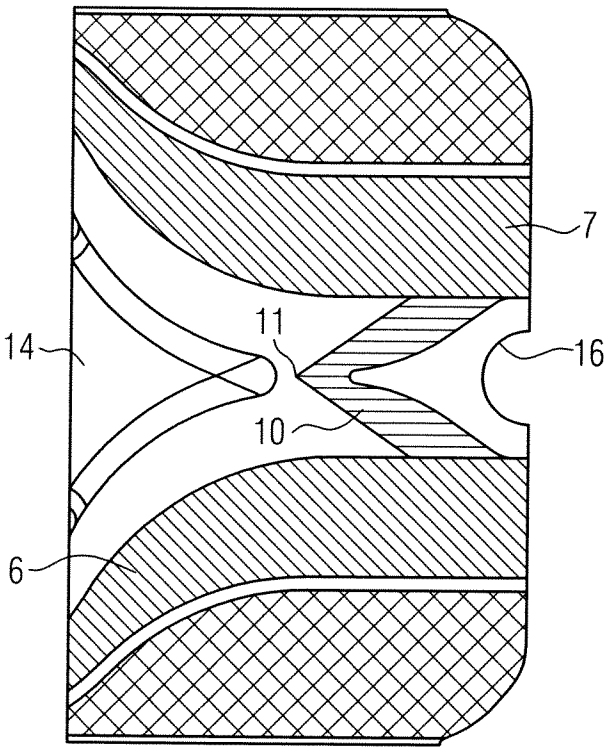
FIG. 8 shows an enlarged view of the sealed seam of the packaging illustrated in FIG. 5.

FIG. 8 shows the sealed seam 10 of the second embodiment in an enlargement. The hatching of the sealed seam 10, which deviates from the connecting area 6, illustrates the differences in the formation of the sealed seam 10 and the connecting area 6. It would also be conceivable to produce the sealed seam 10 with a lower sealing temperature and/or with a lower sealing pressure than a sealing in the connecting area 6, so that the holding forces at the sealed seam 10 are lower than in the connecting area 6.

Figure 9:
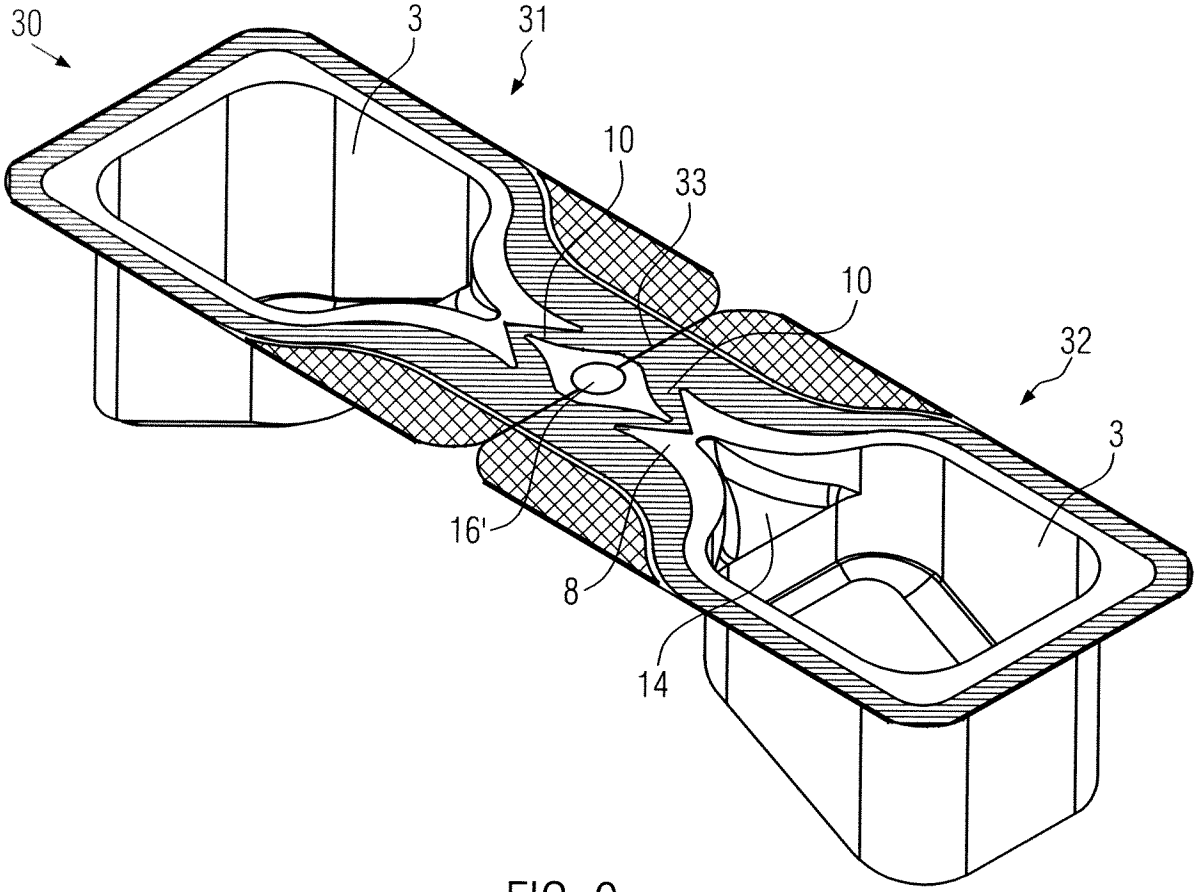
FIG. 9 shows a perspective view of a third embodiment of a packaging according to the disclosure.

FIG. 9 shows a third embodiment of the packaging 30 according to the disclosure. This packaging 30 comprises a first packaging portion 31 and a second packaging portion 32, which are connected to each other along a bending line 33. Each of the two packaging portions 31, 32, i.e. each of the two packaging halves, corresponds exactly to the first embodiment of a packaging 1 shown in FIG. 1. The two packaging portions 31, 32 are mirror-symmetrical to each other with respect to the bending line 33. Moreover, with respect to the longitudinal axis of their own dispensing channel 8, they are mirror-symmetrical to themselves. Each of the two packaging portions 31, 32 has a hollow space 3 in which it can receive a product.

In the center between the two dispensing channels 8, which are directed towards each other, a circular cut-out 16' is provided in the packaging, which is composed of the two semicircular cut-outs 16 of the individual packaging portions 31, 32. The other portions of the bending line 33 may be weakened, specifically by a weakening in the material of the deep-drawn first packaging part 2, in order to support the bending of the two packaging portions 31, 32 towards each other and, where appropriate, also the separation of the two packaging portions 31, 32 from each other. The weakening along the bending line 33 may also be achieved by a perforation of the first packaging part 2 or both packaging parts 2, 5.

Figure 10:
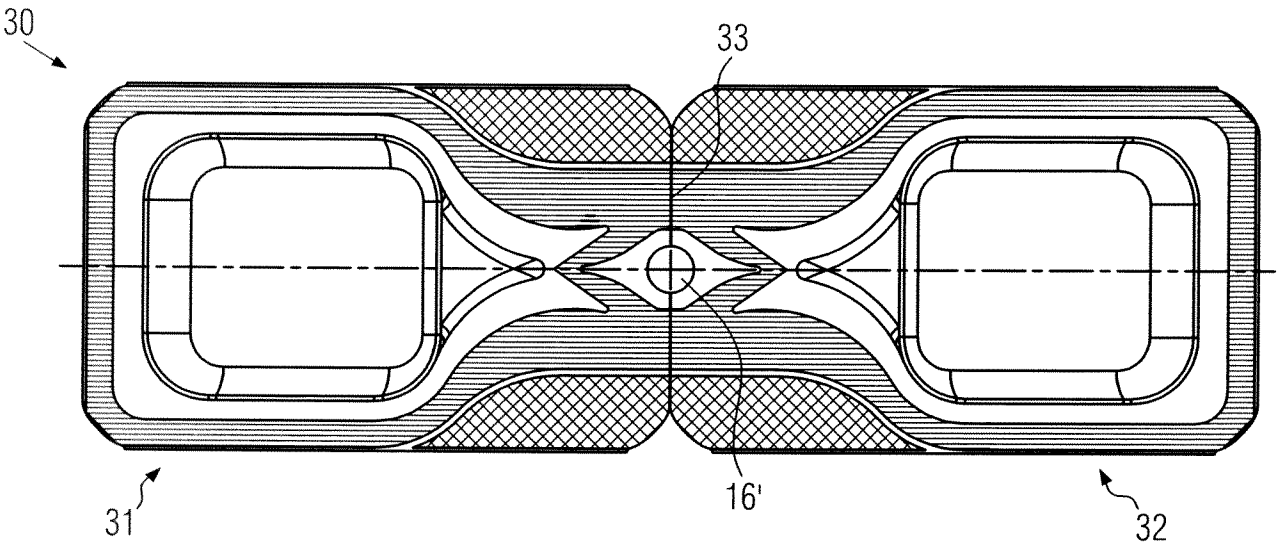
FIG. 10 shows a top view of the packaging illustrated in FIG. 9.

FIG. 10 shows a top view of the multi-chamber packaging 30 illustrated in FIG. 9. Again, it can clearly be seen that the two packaging portions 31, 32 are mirror-symmetrical to each other with respect to the bending line 33 and that the two packaging portions 31, 32 each correspond to a packaging 1 of the first embodiment. It can also be seen that the sealed seams 10 are offset relative to the bending line 33 towards the hollow space 3 of the respective packaging portion 31, 32, so that the sealed seam 10 does not reach as far as the bending line 33. This ensures that bending the packaging 30 alone cannot yet cause damage to the sealed seams 10, but that only an increase of the internal pressure in one or both packaging portions 31, 32 results in opening up the respective sealed seam 10.

Figure 11:
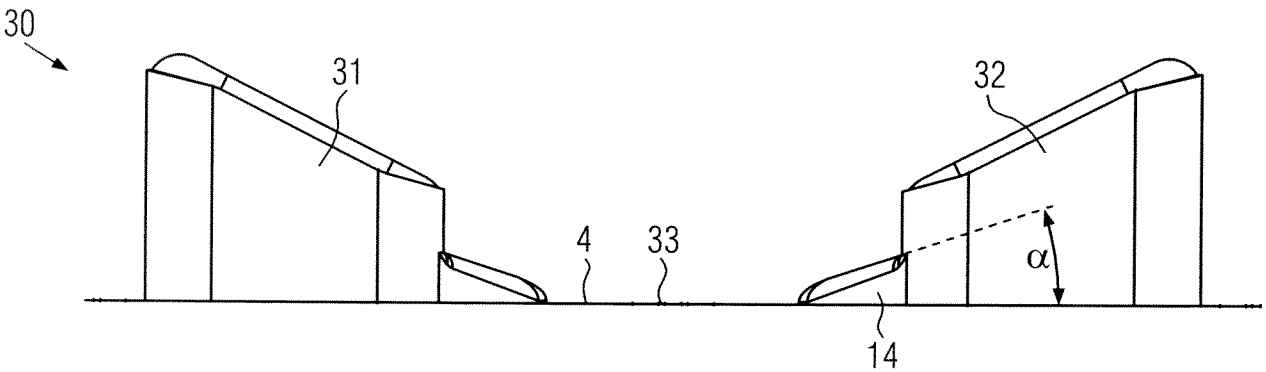
FIG. 11 shows a lateral view of the packaging illustrated in FIG. 9.

FIG. 11 shows a lateral view of the third embodiment of a packaging 30. In the lateral view, too, each packaging portion 31, 32 corresponds to the first embodiment of a packaging 1. The bending line 33 is located on the plane of edge 4 of the two packaging portions 31, 32. Each packaging portion may have a filling volume, for instance, of 40 to 60 ml. Like in the other embodiments, the angle $\alpha$, at which the bottom of the funnel-shaped portion 14 is inclined relative to the plane of edge 4, is 15 to 20°, preferably 18°.

Figure 12:
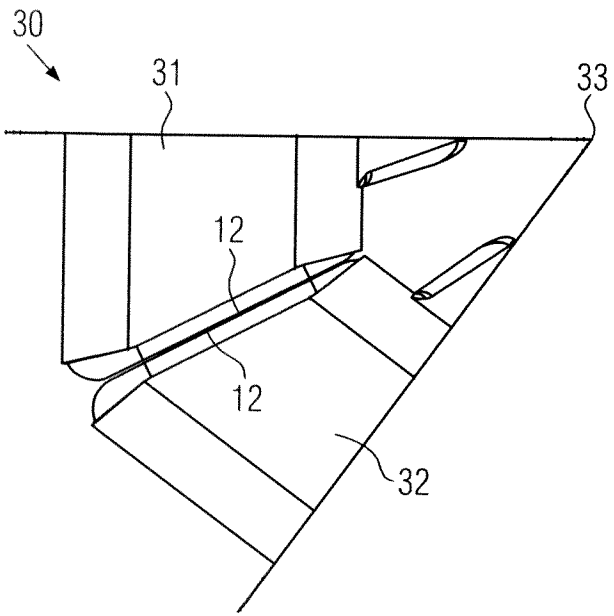
FIG. 12 shows a lateral view of a first modification of the packaging illustrated in FIG. 9 bent around the bending line.

FIG. 12 shows the multi-chamber packaging 30 illustrated in FIGS. 9 to 11 in a state in which the two packaging portions 31, 32 have been tilted relative to each other around the bending line 33 until they are adjacent to each other with their bottoms 12. The bottom 12 of each packaging portion 31, 32 is here oriented in such a way that the bending line 33 is located directly along the extension of the plane of bottom 12. Thus, it is achieved that the two packaging portions 31, 32 are adjacent to each other with their respective bottoms 12 in a surface-to-surface manner when they touch each other for the first time.

If, starting from the state shown in FIG. 12, the packaging portions 31, 32 are pressed further towards each other the internal pressure in the hollow spaces 3 of the two packaging portions 31, 32 increases. Due to the contact of the two packaging portions 31, 32, especially by their being adjacent to each other in the surface-to-surface manner, it is ensured that the internal pressure in the hollow spaces 3 of the two packaging portions 31, 32 increases uniformly. Thus, it is achieved that the respective sealed seam 10 is opened up in both packaging portions 31, 32 at the same time and the product is dispensed through the dispensing channel 8. As both dispensing channels 8 are directed towards the bending line 33 the products flowing out of the two packaging portions 31, 32 are already mixed at the bending line.

Figure 13:
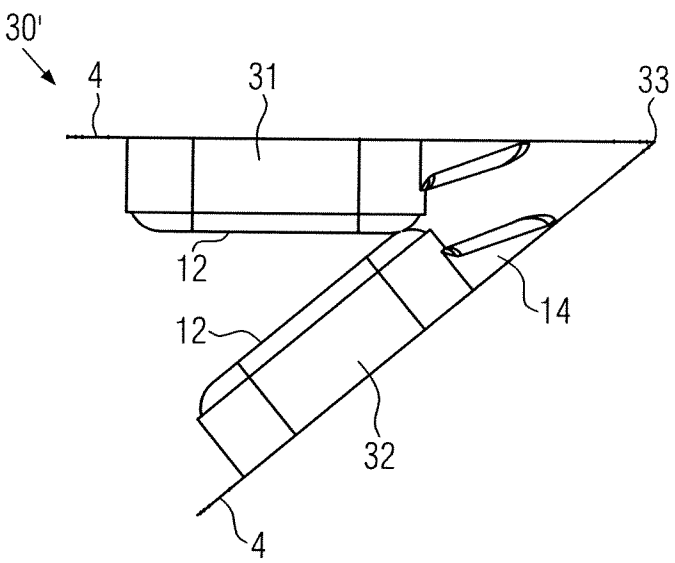
FIG. 13 shows a lateral view of a second modification of the packaging illustrated in FIG. 9.

FIG. 13 shows a modification of the multi-chamber packaging 30'. In this modification the bottoms 12 of the two packaging portions 31, 32 are not oriented relative to the bending line 33, but parallel to the plane of the edge 4 of the respective packaging portion 31, 32. This entails that the packaging portions 31, 32, when they contact each other for the first time, are adjacent to each other not in a surface-to-surface manner, but along a contact line. In the embodiment shown the contact line is located at the junction of the hollow space 3 to the funnel-shaped portion 14 of the respective packaging portion 31, 32. When the bottom 12 is inclined to such an extent that its plane intersects the plane of the edge 4 ahead of the bending line 33, the contact line can also be shifted to the opposite, rear end of the hollow space 3 of the respective packaging portion 31, 32 in order to allow that the product can be pressed out forwards through the dispensing channel 8.

The inventive packaging machine for manufacturing the packaging 1, 20, 30, 30' is preferably a deep-drawing machine, in which the hollow spaces 3 are deep-drawn in a molding station into the lower first packaging part 2 before the hollow spaces 3 are filled with a liquid, powdery or pasty product in a filling station. Next, the second packaging part 5, i.e. the lid film, is applied to the first packaging part 2 and sealed on in a sealing station. Simultaneously with connecting the two packaging parts 2, 5 in the connecting area 6, or in a separate working step, the sealed seam 10 in the dispensing channel 8 is produced. Finally, the cut-outs 16, 16' and, where appropriate, perforations along the bending line 33 may be produced in another work station, before the packagings 1, 20, 30, 30' are singled.

Based on the illustrated and described embodiments the inventive packaging 1, 20, 30, 30' may be modified in many ways. Specifically, it is conceivable that the sealed seam 10 comprises several projecting portions 11, and that the projecting portion(s) 11 is/are provided not towards the hollow space 3, but on the side of the sealed seam 10 that is directed outwardly. In this case it is particularly favorable if a recess is provided on the inner side of the sealed seam at the height of the outwardly projecting portion 11 to allow a concentration of the separation forces in this area as the internal pressure in the packaging 1, 20, 30 increases.

While embodiments of the disclosure have been illustrated and described, it is not intended that these embodiments illustrate and describe all possible forms of the disclosure. Rather, the words used in the specification are words of description rather than limitation, and it is understood that various changes may be made without departing from the spirit and scope of the disclosure.

What is claimed is:

1. Packaging for a liquid, powdery or pasty product, the packaging comprising a first packaging part and a second packaging part which are connected to each other along a connecting area and define between them a hollow space to receive the product, wherein a channel is provided between the first packaging part and the second packaging part, which is to be opened by opening a sealing element to dispense the product from the packaging, wherein the sealing element is a sealed seam between the first packaging part and the second packaging part, which seals the channel, and that the sealed seam comprises inside the channel at least one projecting portion which projects in a longitudinal direction of the channel;

wherein the first packaging part comprises a first packaging portion and a second packaging portion connected to each other along a bending line, and wherein the hollow space has a first hollow space portion associated with the first packaging portion and a second hollow space portion associated with the second packaging portion; and wherein the bending line includes a cut-out portion of both the first and second packaging parts.

2. Packaging according to claim 1, wherein a width of the sealed seam is narrower at the at least one projecting portion than offside of the at least one projecting portion.

3. Packaging according to claim 1, wherein the at least one projecting portion is disposed on the side of the sealed seam facing the hollow space that receives the product.

4. Packaging according to claim 1, wherein the at least one projecting portion of the sealed seam is disposed centrally in the channel.

5. Packaging according to claim 1, wherein the first packaging part and the second packaging part lie on top of each other surface to surface in an area of the channel proximate the sealed seam.

6. Packaging according to claim 1, wherein the sealed seam comprises several projecting portions on the side of the sealed seam facing the hollow space that receives the product.

7. Packaging according to claim 1, wherein the sealed seam is V-, U-, W-, C, E- or M-shaped.

8. Packaging according to claim 1, wherein the sealed seams in the channels of the two packaging portions are offset relative to the bending line towards the hollow spaces of the respective packaging portion.

9. Packaging according to claim 1, wherein the cut-out is arranged between two channels of the two packaging portions.

10. Packaging according to one of claim 1, wherein the cut-out is circular.

11. Packaging according to claim 1, wherein a sealed seam separation force required to separate the first packaging part from the second packaging part at the sealed seam is less than a connecting area separation force required to separate the first packaging part from the second packaging part at the connecting area

12. Packaging according to claim 11, wherein a sealing broader than that of the sealed seam is provided at least section-wise in the connecting area.

13. Packaging according to claim 1, further comprising a funnel-shaped portion between the hollow space and the channel.

14. Packaging machine for manufacturing the packaging according to claim 1.

15. The packaging according to claim 1, wherein said cut-out is disposed to direct a flow of a product out of one of said first and said second channels.

16. A packaging for a liquid, powdery or pasty product, the packaging comprising a package housing and a lid connectable to each other along a connecting area to define a first hollow space and a second hollow space therebetween, the hollow spaces operable to receive a the product, the packaging further comprising a first channel disposed between the package housing and the lid in fluid communication with the first space, and a second channel disposed between the package housing and the lid in fluid communication with the second hollow space, wherein said first channel and said second channel are coterminous at a bending line disposed on the package housing between the first hollow space and the second hollow space, and wherein the bending line includes a cut-out portion of the packaging housing and the lid, the packaging further comprising a first releasable sealing element that closes the first channel when sealed and opens the first channel when unsealed to dispense the product from the first hollow space of the package housing, a second releasable sealing element that closes the second channel when sealed and opens the second channel when unsealed to dispense the product from the first hollow space of the package housing wherein each of the sealing elements is a sealed seam between the package housing and the lid, which seals the respective channel, and wherein each sealed seam comprises at least one projecting portion that projects in a longitudinal direction inside the respective channel.

17. The packaging according to claim 16, wherein each the sealed seam of each sealing element is narrower at the at least one projecting portion than at locations spaced laterally from the at least one projecting portion.

18. The packaging according to claim 16, wherein the at least one projecting portion of each sealing element is disposed on the side of the sealed seam facing the respective hollow space.

19. The packaging according to claim 16, wherein said cut-out is disposed to direct a flow of a product out of one of said first and said second channels.

* * * * *